US007278937B2

(12) United States Patent
Laliberty et al.

(10) Patent No.: US 7,278,937 B2
(45) **Date of Patent: *Oct. 9, 2007**

(54) SPORT BALL WITH SELF-CONTAINED INFLATION MECHANISM HAVING PRESSURE RELIEF AND INDICATION CAPABILITY

(75) Inventors: Ronald P. Laliberty, Dudley, MA (US); Michael Maziarz, Wilbraham, MA (US)

(73) Assignee: Russell Corporation, Atlanta, GA (US)

( * ) Notice: Subject to any disclaimer, the term of this patent is extended or adjusted under 35 U.S.C. 154(b) by 184 days.

This patent is subject to a terminal disclaimer.

(21) Appl. No.: 11/035,149

(22) Filed: Jan. 13, 2005

(65) Prior Publication Data

US 2005/0159257 A1 Jul. 21, 2005

(51) Int. Cl.
*A63B 41/12* (2006.01)

(52) U.S. Cl. ..... 473/593

(58) Field of Classification Search ..... 473/593–595, 473/603–605, 607–610
See application file for complete search history.

(56) References Cited

U.S. PATENT DOCUMENTS 602,294 A * 4/1898 Arnold ..... 473/593
2,698,028 A * 12/1954 Lee et al. ..... 137/539
3,119,617 A * 1/1964 Topper ..... 473/593
5,098,095 A * 3/1992 Weiss ..... 473/593
5,238,244 A * 8/1993 Cotter et al. ..... 473/593
5,755,634 A * 5/1998 Huang ..... 473/570
6,261,400 B1 7/2001 Kennedy, III
6,287,225 B1 * 9/2001 Touhey et al. ..... 473/593
6,409,618 B1 * 6/2002 Touhey et al. ..... 473/593
6,422,960 B1 * 7/2002 Touhey et al. ..... 473/593
6,450,906 B1 * 9/2002 Touhey et al. ..... 473/593
6,491,595 B1 * 12/2002 Feeney et al. ..... 473/593
6,702,699 B2 * 3/2004 Touhey et al. ..... 473/593
7,014,582 B2 * 3/2006 Schomburg et al. ..... 473/593
7,033,292 B2 * 4/2006 Kennedy et al. ..... 473/593
2002/0187866 A1 12/2002 Touhey et al.

* cited by examiner

*Primary Examiner*—Steven Wong

(57) ABSTRACT

An inflatable sport ball, such as a basketball, a football, a soccer ball, a volleyball or a playground ball, is provided with a self-contained inflation mechanism, or multiple self-contained inflation mechanisms, for inflating or adding pressure to the ball. The mechanism is a pump which is retained inside of the ball and which is operable from outside of the ball to pump ambient air into the ball. The pump additionally contains an integral pressure relief device to selectively relieve the pressure of the ball. Instead or in addition to the pressure relief device, the pump optionally contains a pressure indicating device to determine the relative pressure of the ball. The pressure indicator provides a numerical indication of the internal pressure of the ball as measured or determined by a pressure sensor.

30 Claims, 16 Drawing Sheets

SPORT BALL WITH SELF-CONTAINED INFLATION MECHANISM HAVING PRESSURE RELIEF AND INDICATION CAPABILITY

CROSS REFERENCE TO RELATED APPLICATIONS

This application claims priority upon U.S. application Ser. No. 10/743,895 filed Dec. 22, 2003, now U.S. Pat. No. 7,014,582, issued Mar. 21, 2006, which claims priority upon U.S. provisional application Ser. No. 60/435,225 filed Dec. 20, 2002.

BACKGROUND

The present disclosure relates to sport or game balls that contain mechanisms for inflating or adding pressure to the balls. The inflation mechanisms additionally utilize an integral pressure relief assembly, and/or an integral pressure indicating device. The inflation mechanisms include a pressure sensor and indicator assembly that measures the internal pressure of the ball and provides an indication of the measured pressure.

Conventional inflatable sport balls, such as basketballs, footballs, soccer balls, volleyballs and playground balls, are inflated through a traditional inflation valve using a separate inflation needle that is inserted into and through a self-sealing inflation valve on the ball. A separate pump, such as a traditional bicycle pump, is connected to the inflation needle and the ball is inflated using the pump. The inflation needle is then withdrawn from the inflation valve which then self-seals to maintain the air pressure within the ball. This system works fine until the ball needs inflation or a pressure increase and a needle and/or pump are not readily available.

Additionally, the amount of air pressure present in conventional inflatable sports balls is generally determined by "feel" of the ball to the player. For example, the surface of the ball may be pushed inwardly by the player or "bounced" against a hard surface. Additional air pressure can be added until a general desired "feel" is obtained. However, such a range of feel can vary from player to player. Moreover, it is important in some balls not to exceed the maximum air pressure limitations set forth by the manufacturer.

More recently, inflatable sport balls have been developed that have built-in integral pumps. For example, the present assignee has filed a number of patent applications and at present, has received several patents directed to various aspects of that subject matter. Although the recently developed sport balls with self-contained inflation mechanisms have received praise and acclaim in the industry, a need remains for an improved sport ball.

In this regard, one problem associated with inflatable sport balls, relates to determining or confirming, the pressure inside the ball. Inserting a pressure gauge into the inflation valve on a ball to obtain a measurement of the ball's pressure invariably results in leakage of air from the ball. Such leakage in turn further reduces the ball pressure, and may require another pumping or filling operation to add additional air to the ball.

It is also desirable to accurately determine the pressure rather than relying upon the "feel" or "bounce" of the ball. Additionally, since the feel or bounce of a ball is subjective, people often have different views as to whether a ball is sufficiently pressurized.

An inflatable sport ball having an on-board pressure indicator is known and described in U.S. Pat. No. 5,755,634 to Huang, herein incorporated by reference. Although that ball and pressure display may be satisfactory, in order to inflate the ball, a separate pump or inflation mechanism is required. Hence, a need remains for an improved ball having an integral pressure indicator, particularly for inflatable sport balls having self-contained inflation mechanisms.

Accordingly, it would be desirable to produce an inflatable sports ball with an integral pressure sensor, pressure indicator, and a self-contained inflation mechanism.

BRIEF DESCRIPTION

An object of the present disclosure is to inflate or add pressure to a sport ball without the need for separate inflation equipment such as a separate inflation needle and pump, and to be able to reduce or relieve the pressure of the ball if necessary.

Another object of the present development is to easily determine the pressure of a sport ball, without the use of a separate pressure indicating or measuring device.

Another object of the disclosure is to determine the pressure of a sport ball without significant loss of air from the pressurized interior of the ball.

The present development provides a sport ball comprising a self-contained inflation mechanism with an optional integral pressure relief device. The development also provides a sport ball comprising multiple self-contained inflation mechanisms in which at least one of the inflation mechanisms includes an integral pressure relief device. Specifically, the disclosure relates to a sport ball that has at least one self-contained pump device which is operable from outside the ball and which pumps ambient air into the ball to achieve the desired pressure. The pump also comprises an assembly for reducing or relieving the pressure of the ball. Additionally, the pump may have an integral pressure sensor and indicator assembly to determine the relative pressure of the ball.

Since the pressure in a sport ball can be too high through overinflation or a temperature increase, or too low through underinflation or air loss, it is beneficial to have a pressure relief mechanism, and optionally, a pressure-indicating device that is integral with an on-board pump. If the pressure is too low, additional air may be added using the self-contained pump of the development. If the pressure is too high, the pressure may be relieved by bleeding pressure from the ball with the pressure relief mechanism described herein. Once the pressure has been relieved, the pressure-indicating device, if present, may then be used to determine if the ball is correctly inflated. If too much air is removed, additional air may be added using the pump.

In a first aspect, the present disclosure provides an inflatable sport ball having an integral pump, pressure sensor and indicator assembly, and pressure relief mechanism. The ball comprises a flexible carcass including an inflatable bladder having an interior adapted for retaining pressurized air, and an outer layer disposed on the bladder. The ball further comprises a pump cylinder secured to the carcass. The cylinder includes a distal end at which is disposed a valve. The cylinder defines an interior hollow chamber in communication with the interior of the bladder through the valve. The ball also comprises a pump piston disposed in the cylinder. The piston is positionable within the cylinder and includes a distal end at which is disposed an actuating member. The ball also comprises a pressure sensor and pressure indicator assembly incorporated in the ball and adapted to indicate the internal pressure of the ball. The piston and cylinder are configured such that upon selective positioning of the piston, the actuating member engages the valve to selectively provide passage and escape of pressurized air from within the bladder.

In another aspect, the present development provides an inflatable sport ball having an integral pump and pressure indicating assembly. The ball comprises a flexible carcass including an inflatable bladder having an interior adapted for retaining pressurized air, and an outer layer disposed on the bladder. The ball further comprises a pump cylinder secured to the carcass. The cylinder includes a nozzle end. The cylinder defines an interior hollow chamber in communication with the interior of the bladder through the nozzle end. The ball further comprises a pump piston disposed and positionable within the cylinder. The piston includes a distal end, and further includes a pressure sensor and a pressure indicating assembly. The pressure sensor is adapted to sense and measure the pressure of the interior of the bladder, and provide a signal to the pressure indicator representative of the measured pressure. The pressure indicator is adapted to indicate the measured pressure of the ball. Upon engagement between the distal end of the piston and the nozzle end of the cylinder, the pressure sensor is placed in communication with the interior of the ball. This causes the pressure indicator to indicate the pressure within the ball.

In a further aspect, the present disclosure provides an inflatable sport ball having an integral pump, pressure relief mechanism, and pressure indicating assembly. The ball comprises a flexible carcass including an inflatable bladder having an interior adapted for retaining pressurized air, and an outer layer disposed on the bladder. The ball further comprises a pump cylinder secured to the carcass. The cylinder includes a distal end at which is disposed a valve for providing communication with the interior of the bladder. The cylinder defines an interior hollow chamber in communication with the interior of the bladder through the valve. The ball further comprises a pump piston disposed in the cylinder. The piston is positionable within the cylinder. The piston includes a pressure indicating assembly and a distal end at which is disposed an actuating member. The piston and cylinder are configured such that upon selective positioning of the piston, the member engages the valve to selectively provide passage and escape of pressurized air from within the bladder, and the pressure sensor is placed in communication with the interior of the bladder to thereby cause the pressure indicator to indicate the pressure within the ball interior.

In yet a further aspect, the present development provides a pump adapted for incorporation in an inflatable sport ball. The pump comprises a cylinder having a nozzle end, a valve disposed at the nozzle end, an open end opposite from the nozzle end, and a sidewall extending between the nozzle end and the open end. The open end is adapted for engagement with a carcass of the ball. The pump further comprises a piston movably disposed in the cylinder. The piston includes a distal end at which is disposed an actuating member. The pump also comprises a pressure sensor and pressure indicator incorporated in the piston and adapted to indicate the internal pressure of the ball. The piston and the cylinder are configured such that upon selective positioning of the piston within the cylinder, the actuating member engages the valve to selectively open the valve.

Other objects of the development disclosed herein will become apparent from the specification, drawings and claims.

BRIEF DESCRIPTION OF THE DRAWINGS

The following is a brief description of the drawings, which are presented for the purposes of illustrating the disclosure and not for the purposes of limiting the same.

DETAILED DESCRIPTION

Figure 1:
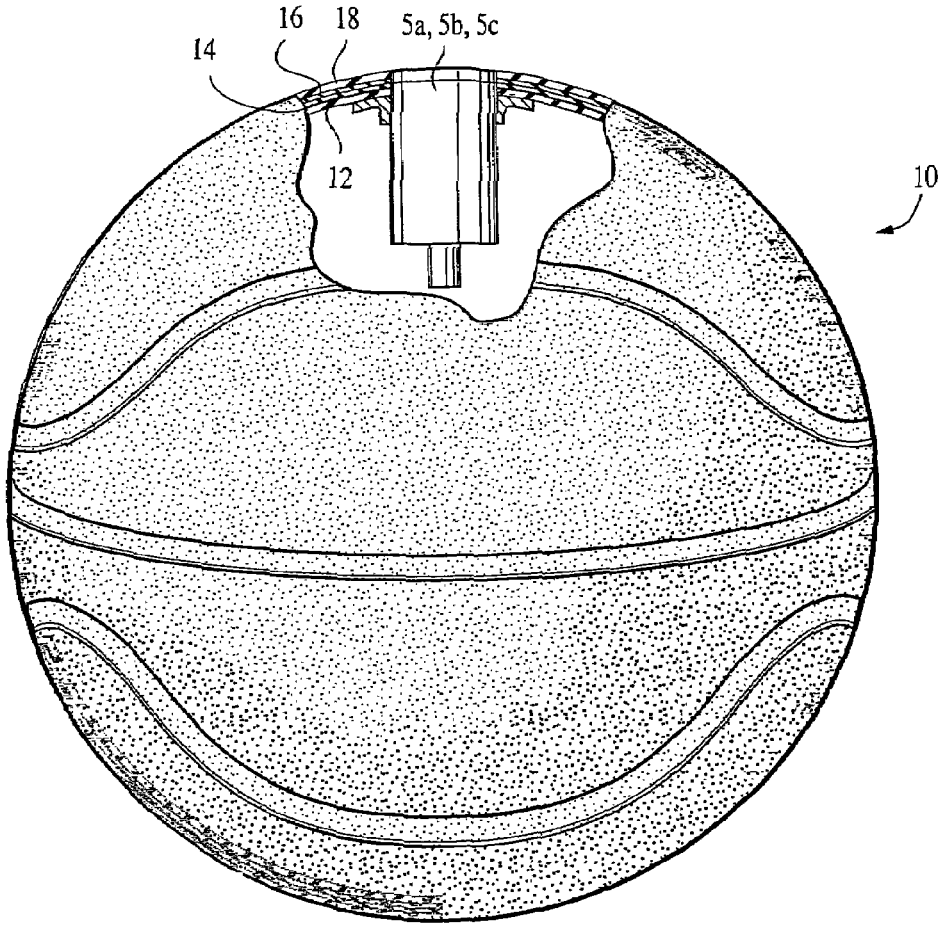
FIG. 1 is a partial cross-sectional view of a basketball utilizing a preferred embodiment pump in accordance with the present development.

Referring to FIG. 1 of the drawings, a sport ball 10 is illustrated incorporating a preferred embodiment inflation pump 5*a*, 5*b*, or 5*c* of the present disclosure. Details of the various pump embodiments 5*a*, 5*b*, and 5*c* are described later herein.

The ball 10 is a typical basketball construction comprising a carcass having a rubber bladder 12 for air retention, a layer 14 composed of layers of nylon or polyester yarn windings wrapped around the bladder 12 and an outer rubber layer 16. As will be understood, the term "carcass" refers to the flexible body of the ball. For a laminated ball, an additional outer layer 18 of leather or a synthetic material may be used. The layer 18 may comprise panels that are applied by adhesive and set by cold molding to layer 16. The windings 14 are randomly oriented and two or three layers thick, and they form a layer that cannot be extended to any significant degree. The windings also restrict the ball 10 from expanding to any significant extent above its regulation size when inflated above its normal playing pressure. This layer 14 for footballs, volleyballs and soccer balls is referred to as a lining layer, and is usually composed of cotton or polyester cloth that is impregnated with a flexible binder resin such as vinyl or latex rubber. The outer layer 18 may be stitched for some sport balls, such as a soccer ball or a volleyball. The outer layer 18 may optionally have a foam layer backing or a separate foam layer.

Figure 2:
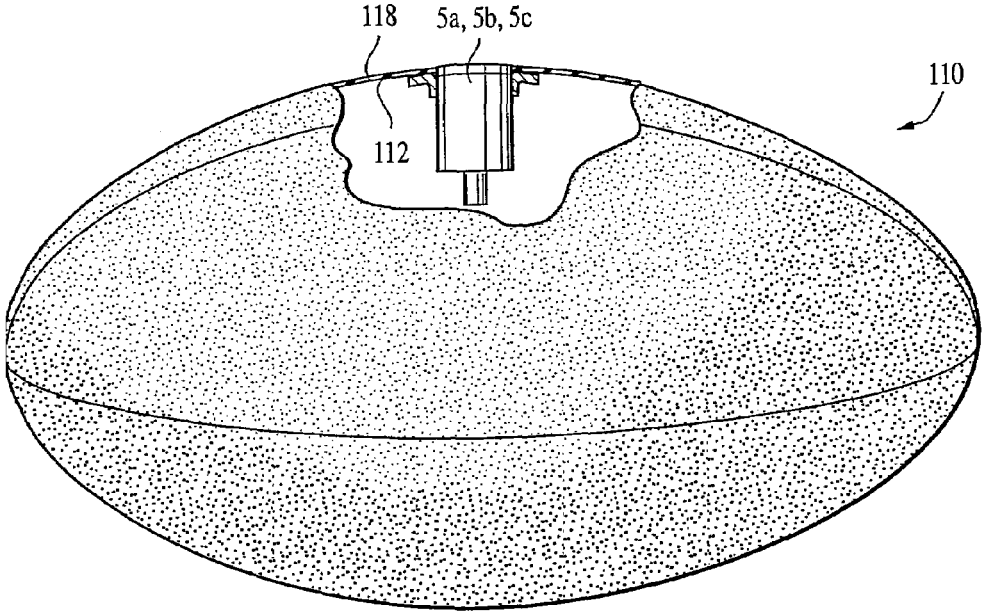
FIG. 2 is a partial cross-sectional view of a football utilizing a preferred embodiment pump in accordance with the present disclosure.

FIG. 2 illustrates a football 110 incorporating a preferred embodiment inflation pump 5*a*, 5*b*, or 5*c* according to the present development. The football 110 comprises a carcass having a rubber bladder 112 for air retention, and an outer layer 118 of leather or synthetic material. As will be appreciated, the carcass of the football 110 may include one or more additional layers such as a winding layer or reinforcement layer, a foam or backing layer, and a secondary rubber lining layer.

Other sport ball constructions, such as sport balls produced by a molding process, such as blow molding, may also be used in the disclosure. For an example of a process for molding sport balls, see, for example, U.S. Pat. No. 6,261,400, incorporated herein by reference.

Materials suitable for use as the bladder include, but are not limited to, butyl, latex, urethane, and other rubber materials generally known in the art. Examples of materials suitable for the winding layer include, but are not limited to, nylon, polyester and the like. Examples of materials suitable for use as the outer layer, or cover, include, but are not limited to, polyurethanes, including thermoplastic polyurethanes; polyvinylchloride (PVC); leather; synthetic leather; and composite leather. Materials suitable for use as the optional foam layer include, but are not limited to, neoprene, SBR, TPE, EVA, or any foam capable of high or low energy absorption. Examples of commercially available high or low energy absorbing foams include the CONFOR™ open-celled polyurethane foams available from Aearo EAR Specialty composites, Inc., and NEOPRENE™ (polychloroprene) foams available from Dupont Dow Elastomers.

Figure 3:
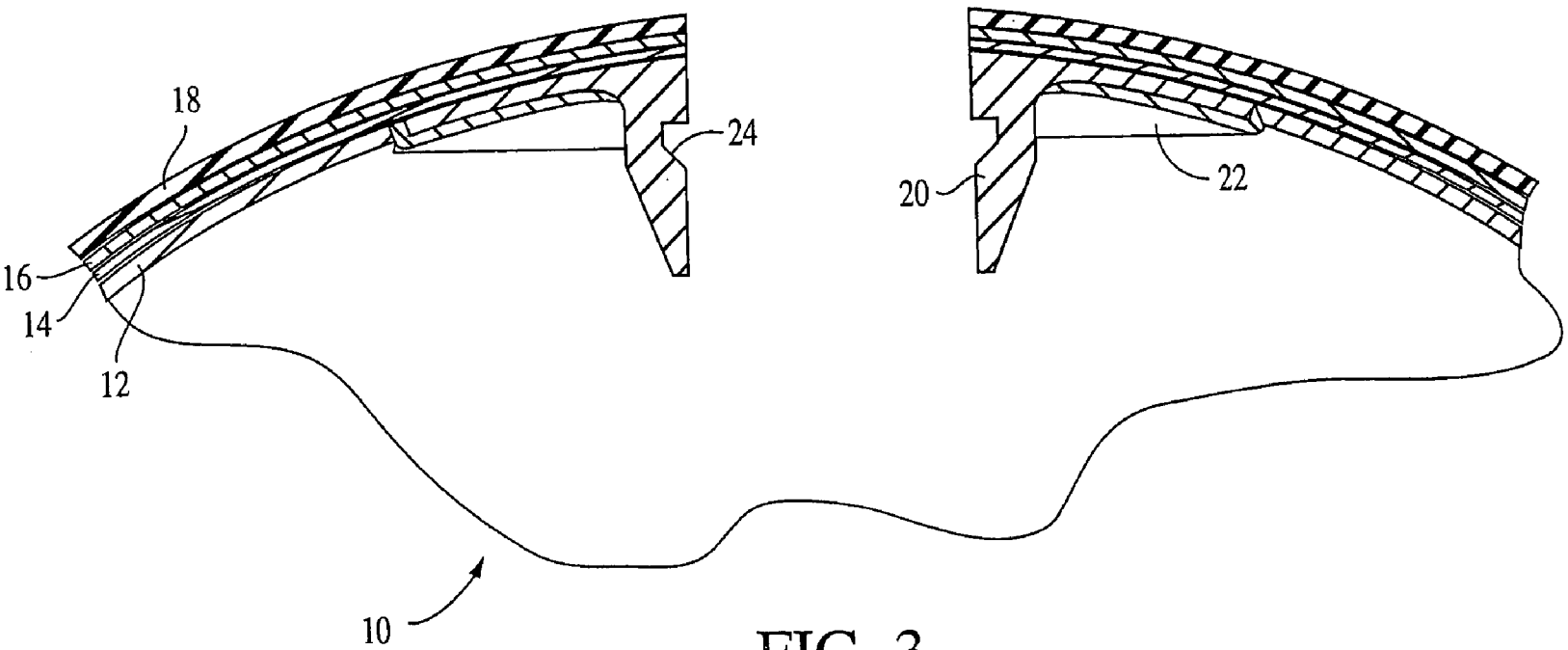
FIG. 3 is a detailed cross-sectional view of a portion of the basketball depicted in FIG. 1 illustrating a preferred mounting configuration for the preferred pump of the present development.

Referring to FIG. 3, incorporated into the carcass of the preferred embodiment ball 10 of the present development during its formation is a rubber pump boot or housing 20. The boot 20 defines a central opening and has an outwardly extending flange 22 which is preferably bonded to the bladder 12 using a rubber adhesive. The boot 20 is preferably disposed between the rubber bladder 12 and the layer of windings 14. The boot 20 may be constructed of any suitable material, such as butyl rubber, natural rubber, urethane rubber, or any suitable elastomer or rubber material known in the art, or combinations thereof. A molding plug (not shown) is inserted into the boot opening during the molding and winding process to maintain the proper shape of the central opening and to allow the bladder 12 to be inflated during the manufacturing process. The molding plug is preferably aluminum, composite or rubber, and most preferably aluminum.

The central opening though the boot 20 is preferably configured with a groove 24 to hold a flange extending from the upper end of a pump cylinder, described in greater detail herein. The pump cylinder can optionally be bonded to the boot 20 using any suitable flexible adhesive (such as epoxy, urethane, cyanoacrylate, or any other flexible adhesive known in the art).

Figure 4:
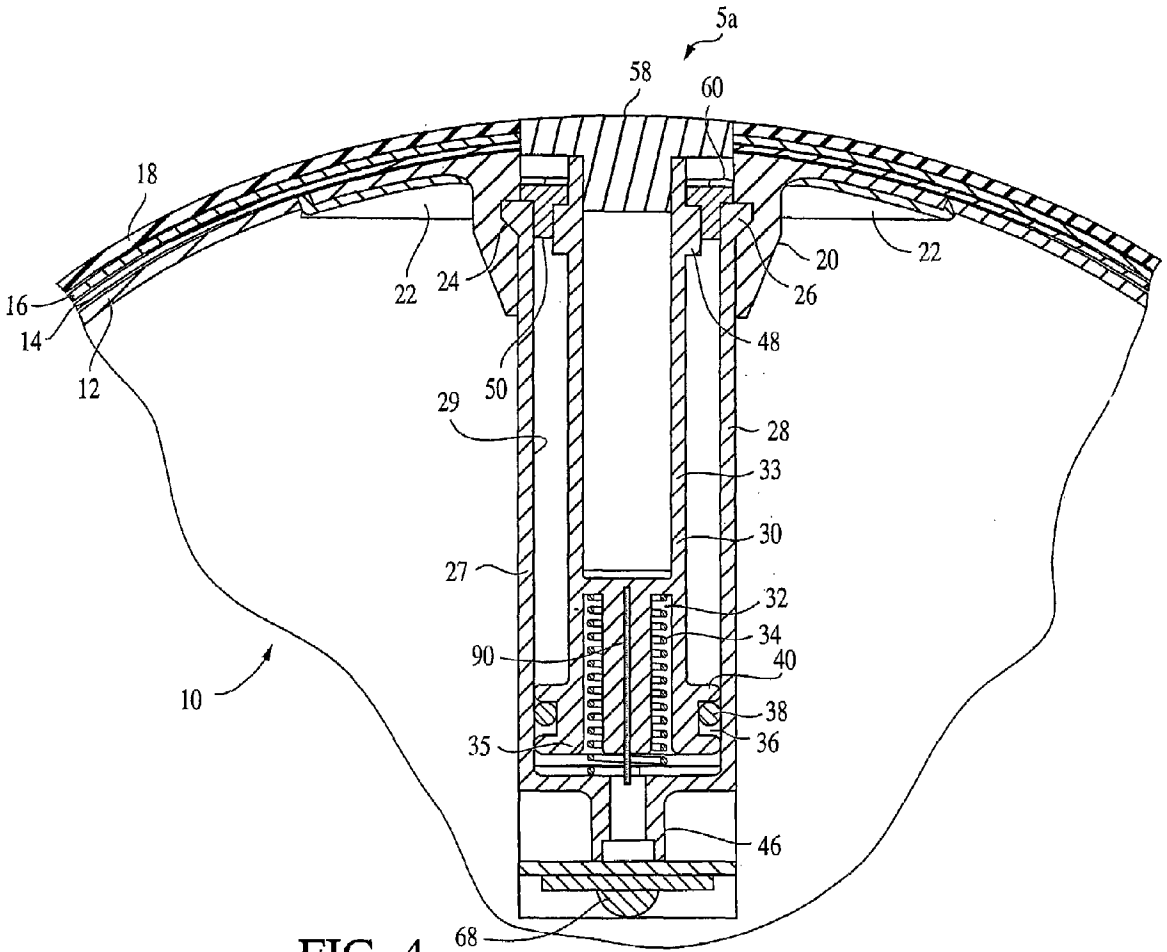
FIG. 4 is a cross section of a portion of a sport ball with a preferred pump and integral pressure relief device, showing a position in which a pump piston is pushed down or in a locked position.
Figure 5:
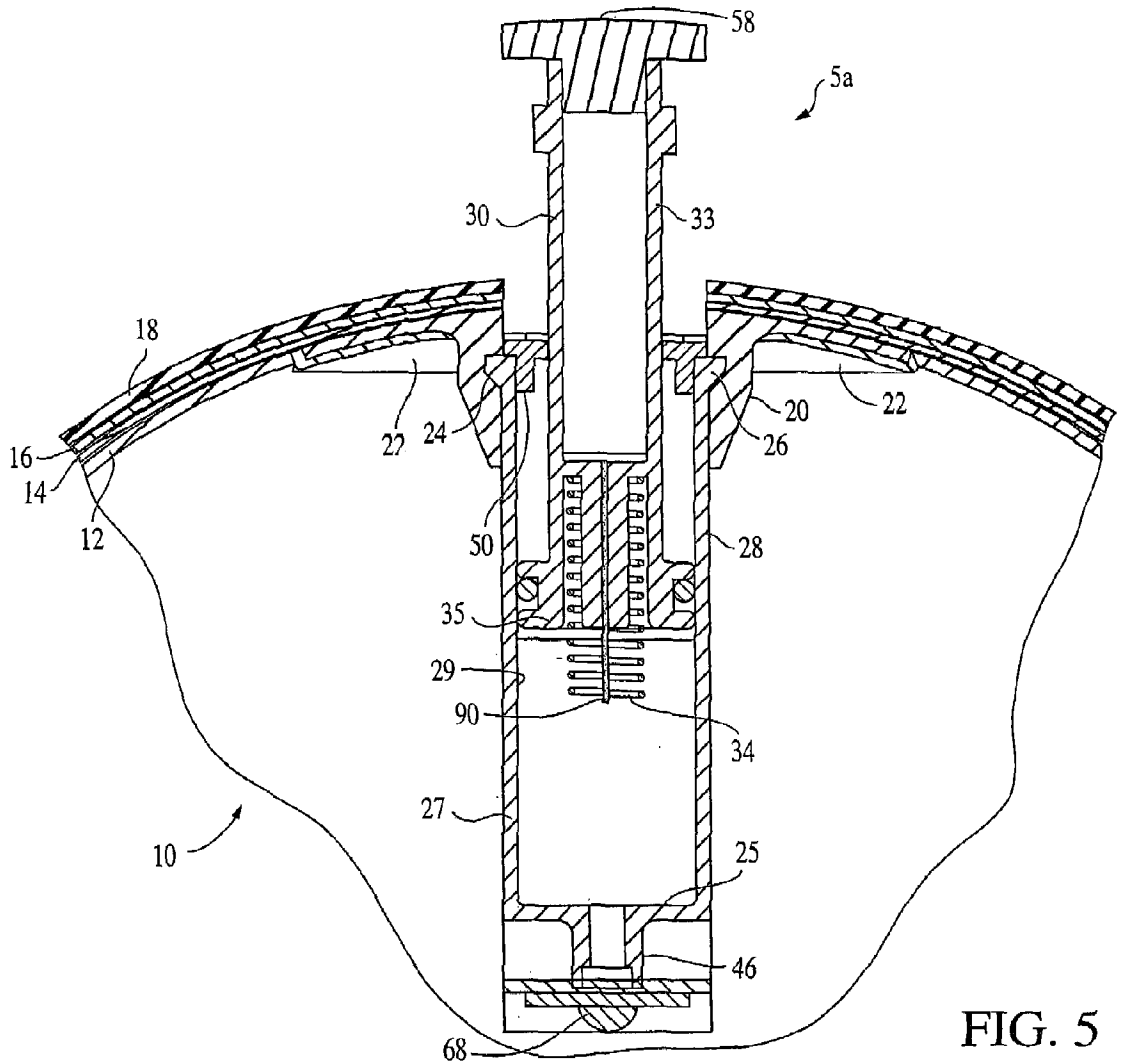
FIG. 5 illustrates the portion of the sport ball shown in FIG. 4 in which the piston is positioned for adding air to the ball.
Figure 6:
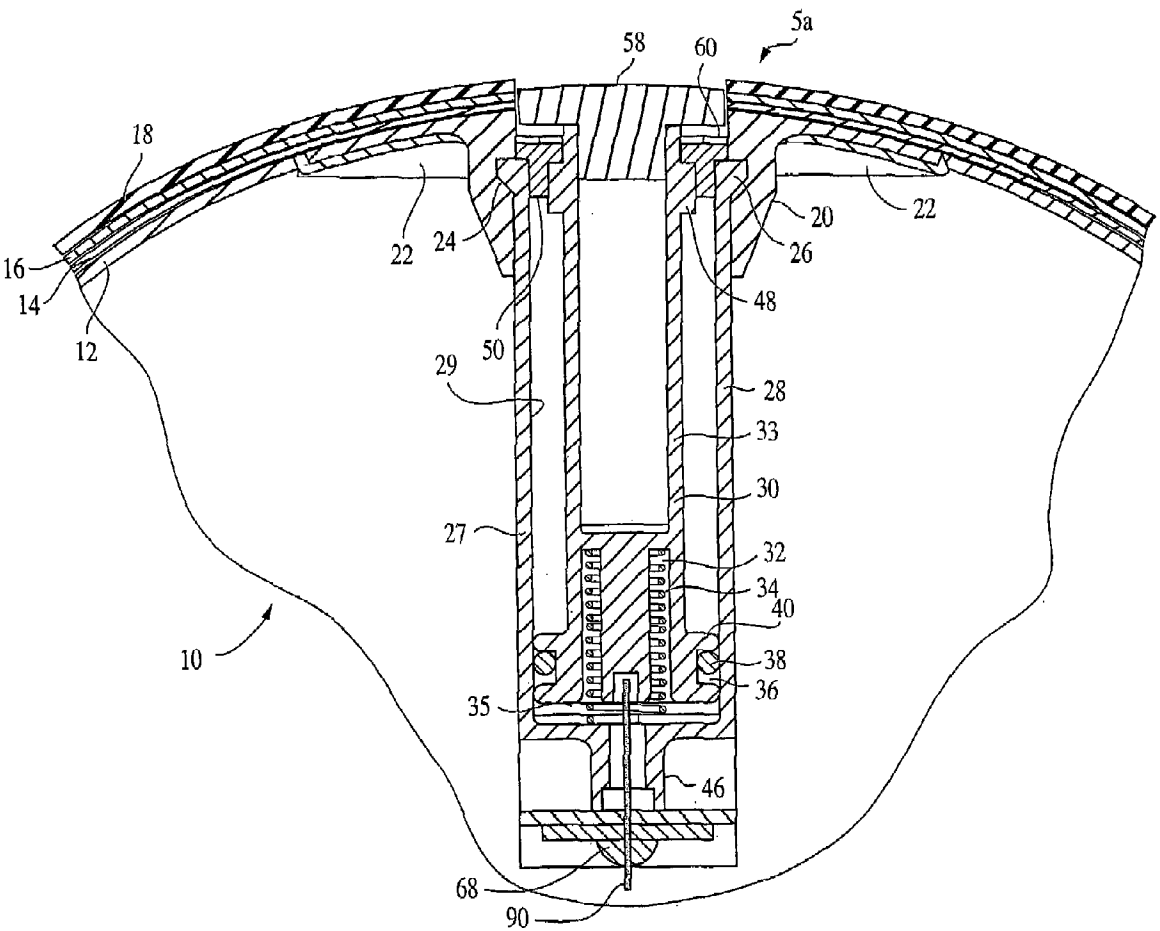
FIG. 6 illustrates the sport ball shown in FIGS. 4 and 5 in which the piston is pushed farther into the pump cylinder and a one-way valve is opened by the pressure relief device to allow air to escape from the ball.

Referring to FIGS. 4-6, a preferred embodiment pump 5*a* having an integral pressure relief device is shown. The pump 5*a* comprises a pump piston 30 disposed in a pump cylinder 28. The pump cylinder 28 includes an open end 26, an exit nozzle 46 defined at an opposite distal end from the open end 26, and a cylindrical sidewall 27 extending between the open end 26 and the exit nozzle 46. The sidewall 27 has an interior face 29. The cylinder 28 also defines an interior end wall 25 which faces the open end 26. The cylinder 28 defines a hollow chamber formed from the interior face 29 of the sidewall 27 and the end wall 25. Although the pump cylinder shown is a right cylinder, other cylinders that are not right cylinders, such as a cylinder having a non-circular cross-section, may be used.

Sealingly disposed within the hollow chamber of the cylinder 28 is the piston 30. The piston 30 includes a cap end 58, and a sealing end 35 opposite from the cap end 58. Extending between the cap end 58 and the sealing end 35 is a body component 33. Defined along the sealing end 35 of the piston 30 is a recess 36 extending along the outer periphery of the body 33, for retaining an O-ring 38. As seen in the referenced figures, this recess 36 is dimensioned such that the O-ring 38 can move in the recess 36. The O-ring 38 is forced into the position shown in FIG. 4 for instance, when the piston 30 is pushed down. In this position, the O-ring seals between the interior face 29 of the cylinder sidewall and an upper flange 40 of the recess 36.

The piston 30 further defines an annular recess 32 accessible from the sealing end 35 of the piston 30 that preferably houses a spring 34. The spring is preferably a coil spring and positioned to urge the piston 30 in the cylinder 28 in a direction away from the cylinder exit nozzle 46. This configuration is preferred for pumps having an integral pressure relief mechanism as described herein. In these embodiments, the function of the spring is to maintain separation between the sealing end 35 of the piston 30 and a valve used for releasing air from the ball. This aspect is described in greater detail herein. It will be appreciated that the present disclosure pumps include piston configurations that do not include the noted annular recess 32 or spring 34.

As noted, a feature of the pump of the present development is the provision of an integral pressure relief mechanism. The preferred pump 5*a* under discussion provides such a mechanism as follows. The piston 30 includes a needle or other suitable device 90 such that upon suitable positioning of the piston 30, the needle 90 forces a valve 68 open to allow air to escape (see FIG. 6). The valve 68 is preferably positioned at the end of the cylinder 28 near the exit nozzle 46. The valve 68 is preferably a one-way valve. The needle 90 is mounted to the sealing end 35 of the piston 30 in any suitable manner. In the embodiment shown, the piston 30 has an opening or passage extending through it to receive the needle 90. The opening or passage also provides an exit for air released from the pressurized interior of the ball. The needle 90 is mounted in or on the piston 30 preferably by adhesive bonding. The needle 90 can be constructed of any suitable material, such as, but not limited to, polycarbonate (PC), polystyrene (PS), acrylic (PMMA), acrylonitrile-styrene acrylate (ASA), polyethylene terephthalate (PET), acrylonitrile-butadiene styrene (ABS) copolymer, ABS/PC blends, polypropylene (preferably high impact polypropylene), polyphenylene oxide, nylon, combinations thereof, or any suitable material known in the art. Materials with high impact strength are preferred. Alternatively, the piston 30 and needle 90 may be formed as one piece or in one operation of the same or different materials. The needle 90 may also in some embodiments, be provided with an interior passage to further facilitate the passage of air from the interior of the ball.

The piston 30 undergoes several functions depending upon its relative position within the cylinder 28. In FIG. 4, the piston 30 is in a locked or secure position such as when the ball 10 is in use. In this position, it is preferred that the outer surface of the cap end 58 of the piston 30 is flush with the outer surface of the ball 10. In FIG. 5, the piston 30 is in an unlocked position in which the pump 5*a* may be used to add air to the ball 10. In FIG. 6, the piston 30 is displaced downward into the cylinder 28 such that the distal end of the needle 90 extends into or through the valve 68 to selectively allow escape of air from the ball 10. As will be understood, the piston 30 is placed in the position shown in FIG. 6 to activate the pressure relief mechanism of the pump.

In another embodiment of the development (not shown), the piston 30 of the pump 5*a* includes a button or valve that activates a device, such as a needle, to open the valve 68. The button could be accessible from the exterior of the ball. In one position when the button is pushed, the needle is engaged with the valve 68 to allow air to escape from the ball interior. When the button or valve is released, the needle is retracted and the valve 68 closes and seals. That is, the button or valve may have two positions, in which the first position opens the valve 68 and allows air to escape, and the second position retracts the needle or device and allows the valve 68 to close or seal. A spring or other member can be used to urge the button or valve to a default position.

Figure 7:
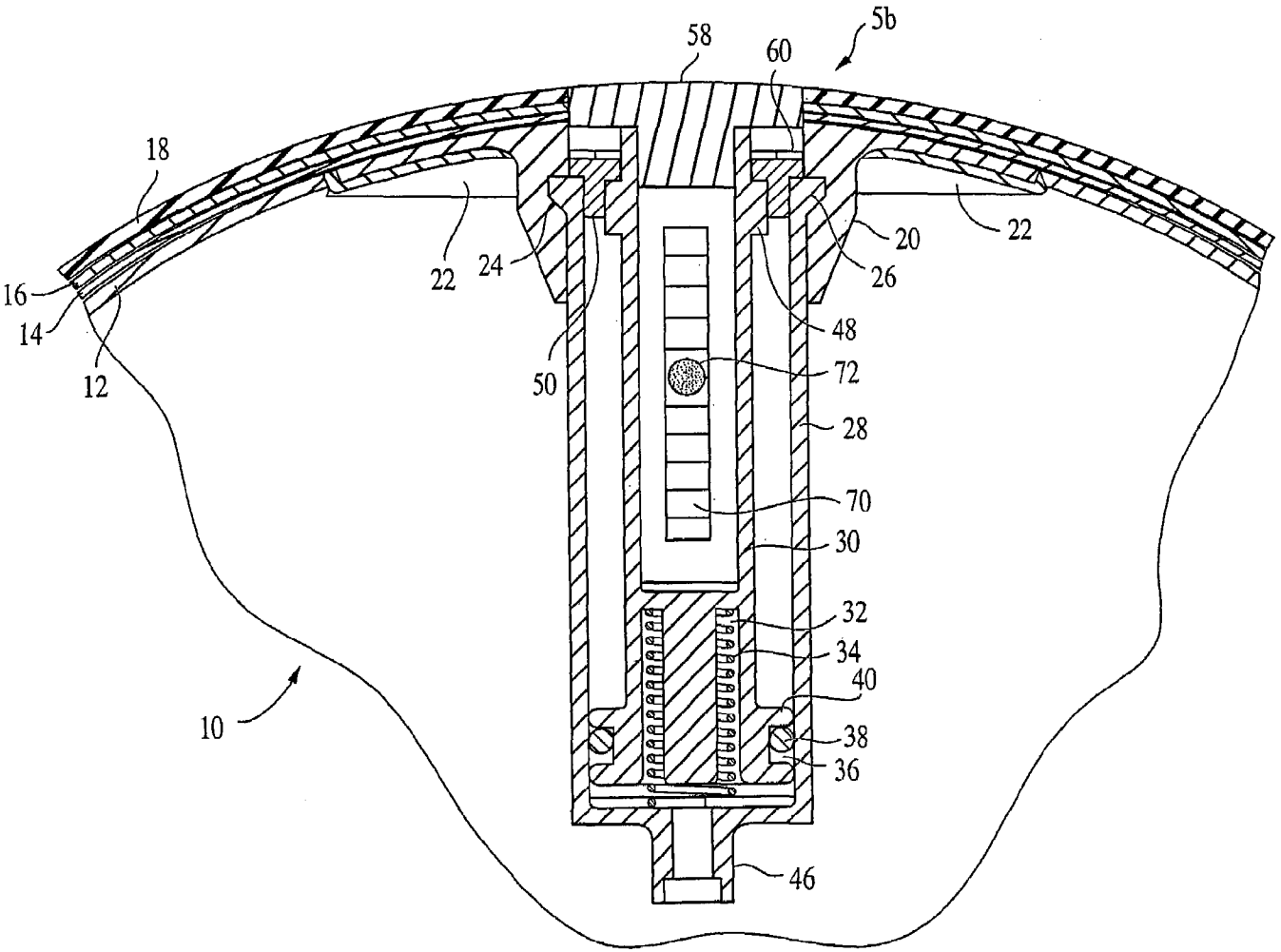
FIG. 7 is a cross section showing a portion of another preferred embodiment sport ball with a preferred embodiment pump and integral pressure indicating device, showing the piston being pushed down into its locked position.
Figure 8:
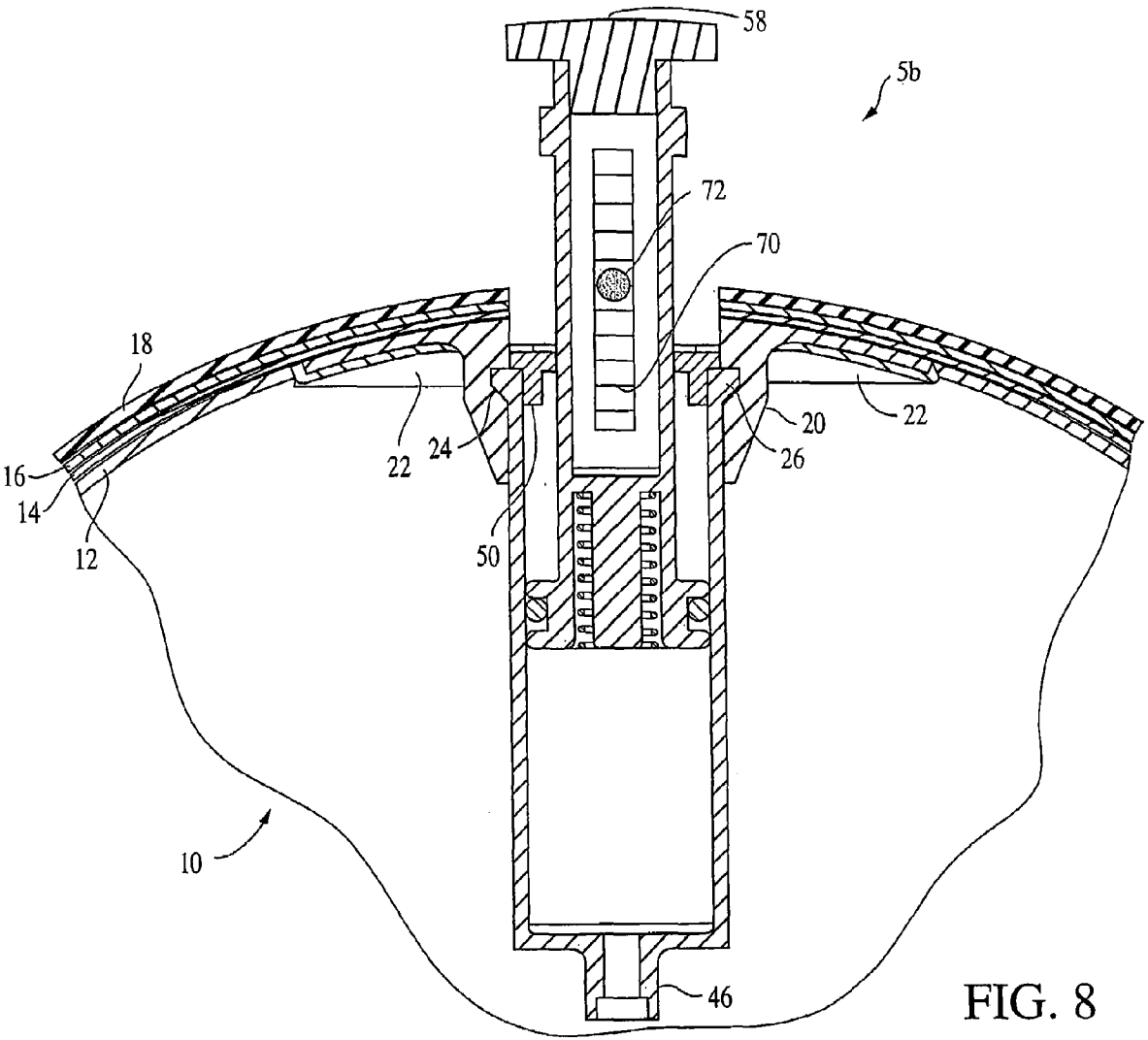
FIG. 8 is another view of the portion of the sport ball shown in FIG. 7 in which the piston is positioned for adding air to the ball.

FIGS. 7 and 8 illustrate another embodiment sport ball 10 of the present development. FIGS. 7 and 8 depict a ball 10 having a preferred embodiment pump 5*b* including a pressure indicating device 72. The device 72 may be in the form of a movable sphere retained within a hollow region defined in the piston 30, or may be in the form of a plurality of pressure indication lines disposed along the length of the piston 30. In determining the pressure of the ball 10, air is allowed to escape the ball and indicate the pressure by displacing the device 72 to a relative position. This position may be further indicated by pressure indication lines 70. A variety of configurations for the cylinder 28 and the piston 30 may be used to selectively allow passage and escape of pressurized air from the ball 10. For example, the distal end of the piston 30 may, upon further displacement into the cylinder, engage a valve such as located in the nozzle of the cylinder or elsewhere, to allow passage of air from the ball, through the hollow region of the piston. An example of a preferred valve and its incorporation in a pump assembly is valve 68 shown in FIG. 4. Flow of air through or past the piston is utilized to activate a pressure indicating device. A preferred pressure indicating device is the previously described sphere 72 that is displaced upward within the hollow region of the piston during escape of pressurized air from the ball. The flow rate of such air is proportional to the pressure of the air within the ball. Depending upon the rate of air flow past the sphere 72, the sphere will be displaced a certain distance within the hollow region of the piston. As noted, it is preferred that the position of the sphere 72 within the piston may be observed. The relative position may be readily noted by providing one or more pressure indication lines 70 to which the position of the sphere 72 may be compared.

It is also contemplated to use the piston 30 and its relative position within the cylinder 28 to indicate the pressure of the ball. In this embodiment, the piston 30 is backed by a spring which counters the force exerted upon the displaced piston 30 by the pressurized air from the ball interior. The position of the piston 30 indicates the ball pressure.

Details of the components of an alternative embodiment, i.e., the pump 5*b*, such as piston 30 and cylinder 28, are as previously described FIGS. 4-6. Related to this embodiment, is a pressure indicating device which features a design in which an indicator is actuated without loss of air from the ball. The previously described embodiment utilized a design in which the pressure of the ball was indicated by a characteristic of a flowing air stream allowed to exit the ball. The alternate design under discussion provides a measure of the ball interior pressure by exposing a pressure indicating surface to the interior pressure. For example, a flexible diagram or other member could be exposed to the ball interior. Upon such exposure, the pressurized air of the interior would displace the diagram by a certain amount which could then be correlated to a pressure value. A preferred assembly using this design is the previously described piston which is backed or otherwise countered by a spring. A face of the piston such as the sealing end 35, is exposed to the ball interior, which results in a force being exerted on the piston causing displacement of the piston within the cylinder. The relative movement of the piston is then correlated to the interior pressure of the ball.

Figure 9:
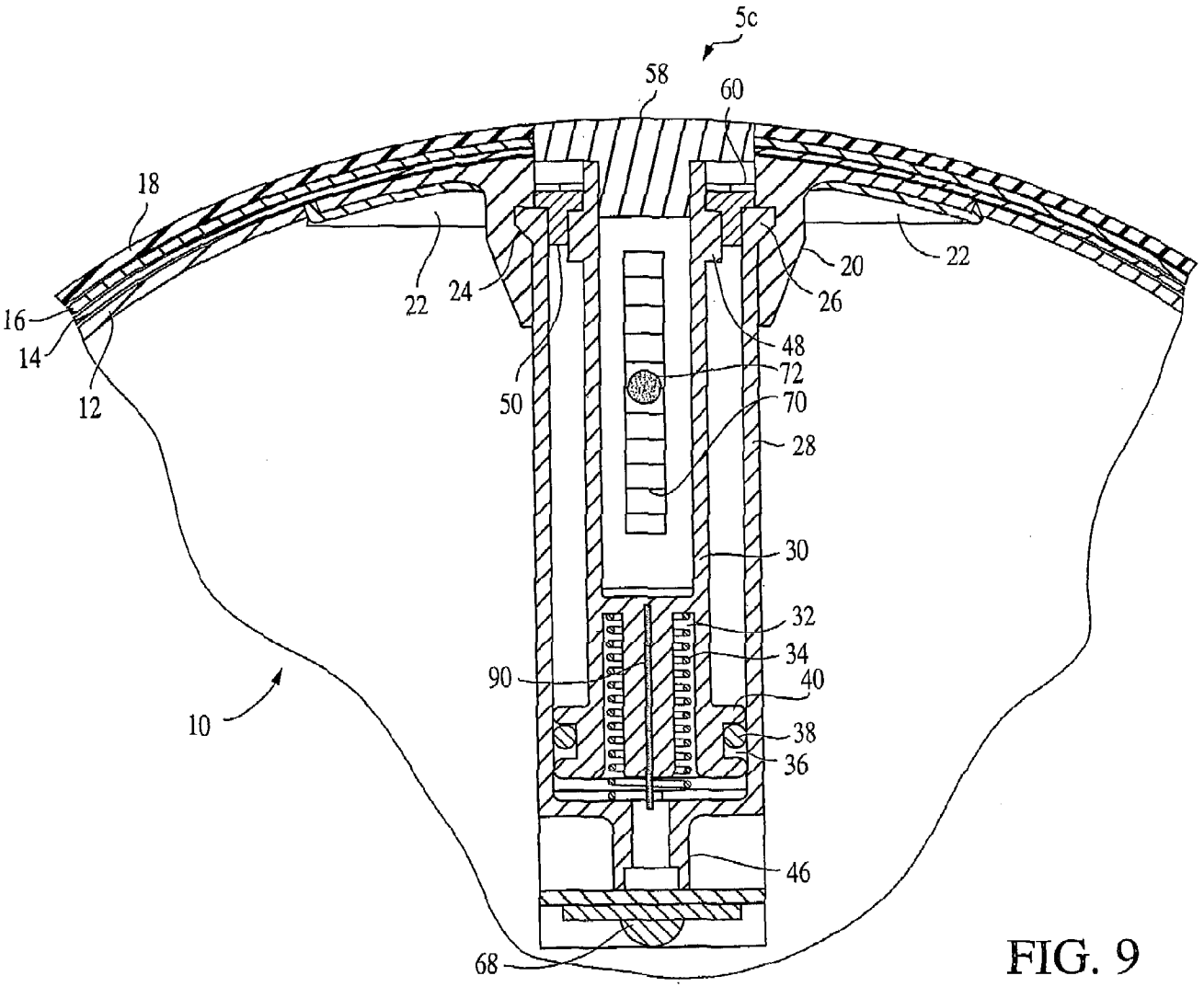
FIG. 9 is a cross section of a portion of another preferred embodiment sport ball with another preferred pump having an integral relief device and a pressure indicating device in accordance with the present disclosure.
Figure 10:
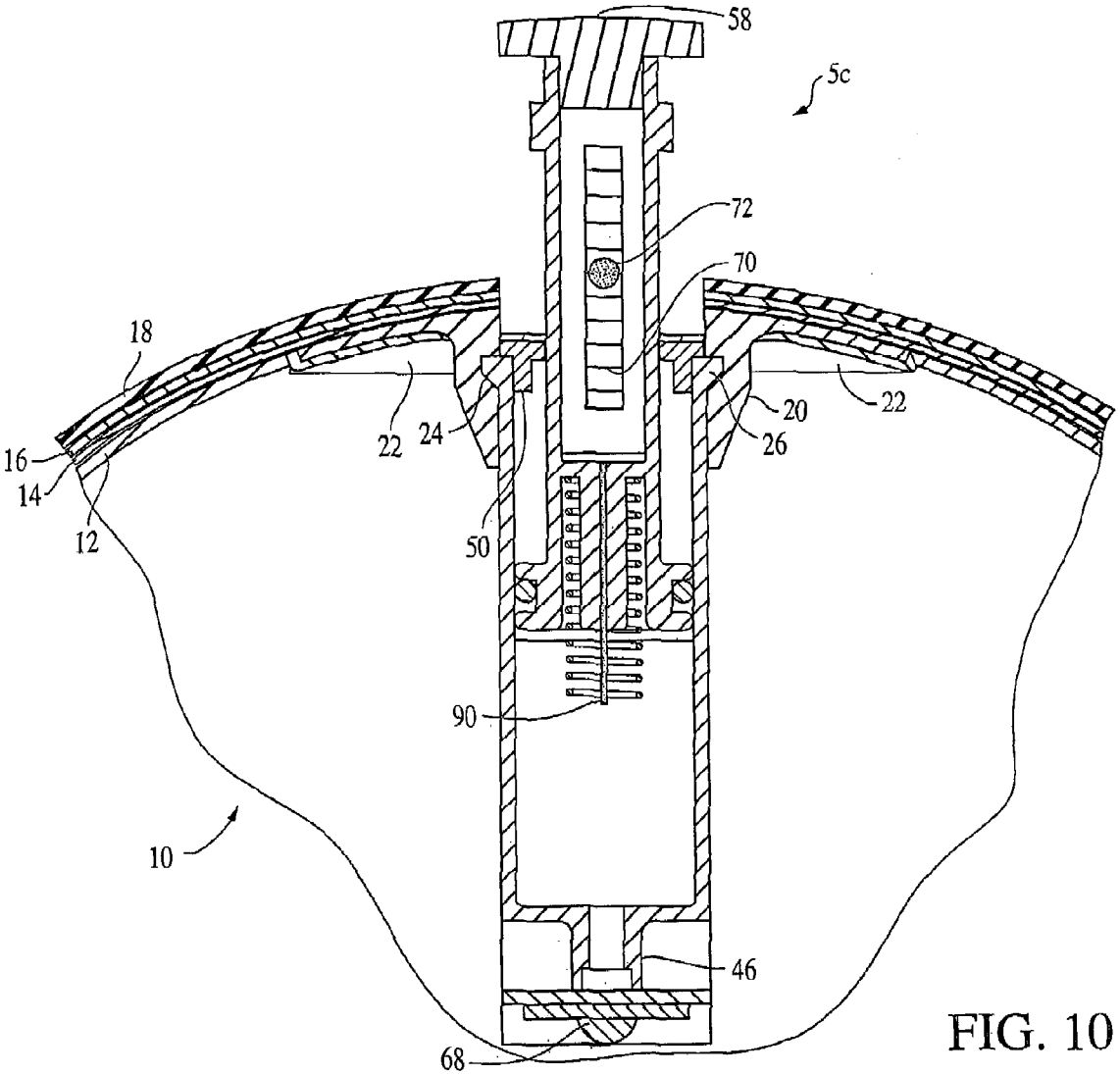
FIG. 10 illustrates the portion of the sport ball shown in FIG. 9 in which the piston is positioned for adding air to the ball.
Figure 11:
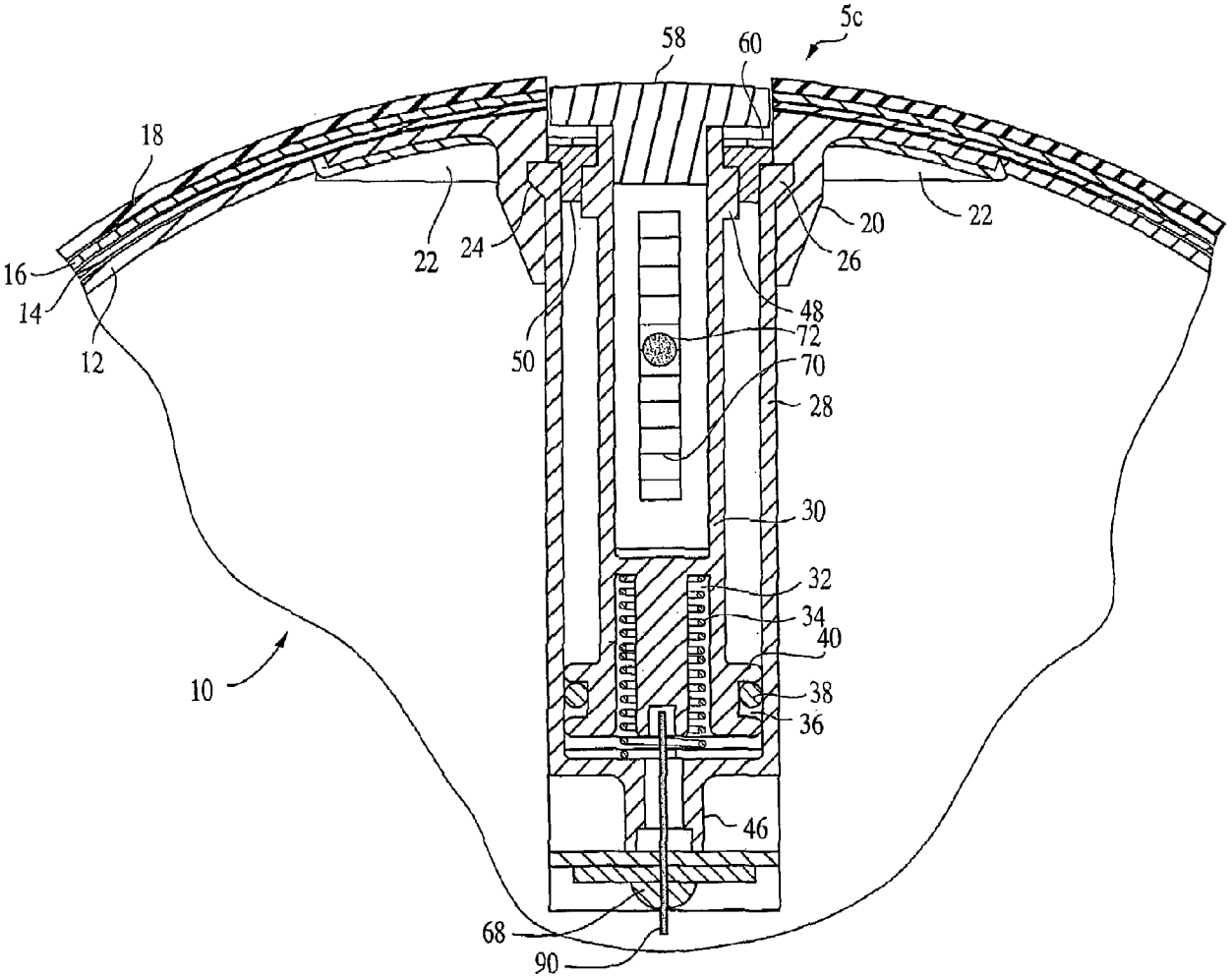
FIG. 11 illustrates the sport ball shown in FIGS. 9 and 10 in which the piston is pushed farther into the pump cylinder and a one-way valve is opened by the pressure relief device to allow air to escape from the ball.

In another embodiment of the disclosure, shown in FIGS. 9-11, a preferred embodiment pump 5*c* includes a pressure indicating device 72 in conjunction with a pressure relieving mechanism. The piston 30 includes a pressure indicating device 72, such as a movable sphere or graduated slide. The piston 30 may also provide pressure indication lines 70. In determining the pressure of the ball 10, air is allowed to escape the ball and indicate the pressure by displacing the device 72 to a relative position thereby indicating the pressure of the ball interior. This position may be further indicated by pressure indication lines provided along the length of the piston 30. One way of achieving this is to allow the one way valve 68 to be opened by the piston 30 of the pump 5*c*. This allows air to escape from the interior of the ball 10 and actuate or move the pressure indication device 72 in the piston 30 due to air flowing through it and exiting the ball 10. In a preferred version, a calibrated spring is provided backing the pressure indication device 72 that allows for precise movement of the pressure indicating device 72 when the air from the interior of the game ball 10 pushes against and flows by the pressure indicating piece 72. Details of the other components of the pump 5*c*, such as piston 30 and cylinder 28, are as previously described in conjunction with FIGS. 4-6.

The preferred embodiment sport balls utilize a particular mounting configuration for securing and incorporating the pumps, such as the preferred embodiment pumps 5*a*, 5*b*, and 5*c*, within the interior of the ball.

Figure 12:
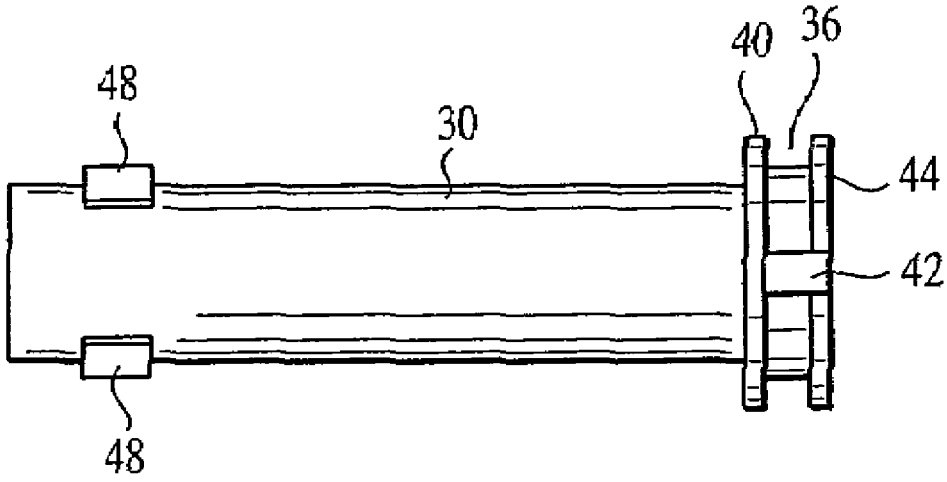
FIG. 12 is a side view of a piston of the preferred embodiment pump.

As shown in FIG. 12, the exterior of the pump piston 30 preferably defines a plurality of recesses or slots 42 in the recess 36 extending from just below the upper flange 40 through a lower or distal most flange 44. Only one of these slots 42 is shown in FIG. 12 but there are preferably two or more. When the piston 30 is forced up by the spring 34, the O-ring 38 moves to the bottom of the recess 36 which opens up a by-pass region around the O-ring 38 through the slots 42 so that air can enter the cylinder 28 below the piston 30. Then, when the piston 30 is pushed down, the O-ring 38 moves back up to the top of the groove and seals to force the air out through the cylinder exit nozzle 46.

Figure 13:
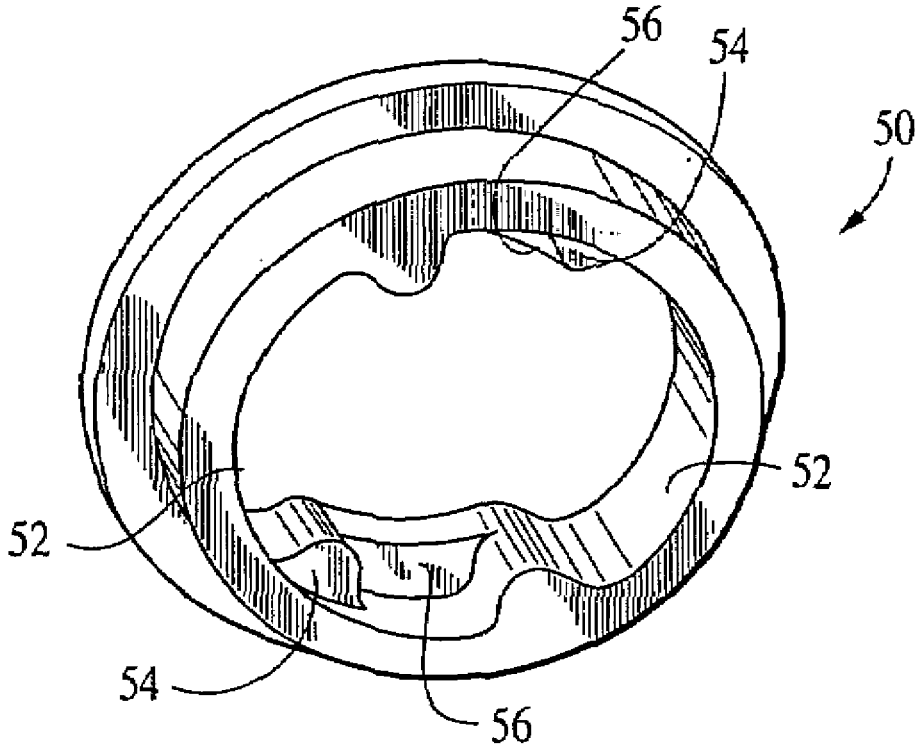
FIG. 13 is a perspective view of a preferred cylinder cap used for securing the pump within a ball.

At the upper end of the piston 30, two outwardly extending flanges 48 are provided that cooperate with a cylinder cap 50 shown in FIG. 13 to hold the piston 30 down in the cylinder 28 and to release the piston 30 for pumping. The cylinder cap 50 is fixed onto the top of the cylinder 28 and the piston 30 extends through the center of the cylinder cap 50. The cap 50 is preferably cemented into the cylinder 28 using a suitable adhesive, such as a UV cured adhesive. FIG. 13 shows an isometric view of the underside of the cylinder cap 50 and illustrates open areas 52 on opposite sides of the central opening through which the two flanges 48 on the piston 30 can pass in the unlocked position. In the locked position, the piston 30 is pushed down and rotated such that the two flanges 48 pass under projections 54 and are rotated into locking recesses 56.

Referring to FIGS. 4-11, attached to the upper end of the piston 30 is a button or cap 58 that is designed to essentially completely fill the hole in the ball carcass. In some embodiments, such as a basketball or football, the button or cap 58 is preferably flush or essentially flush with the surface of the ball. In other embodiments, such as a soccer ball, the button or cap 58 is preferably disposed below the surface of the ball. This button 58 may be of any desired material. Examples of materials suitable for use as the button or cap 58 include urethane rubber, butyl rubber, natural rubber or any other material known in the art. A preferred rubber for use as the button or cap is a thermoplastic vulcanizate such as SANTOPRENE™ rubber, available from Advanced Elastomer Systems, Akron, Ohio. The upper surface of the button or cap 58 should preferably be flexible to match the texture and feel of the outer surface of the ball. For example, the button in a basketball may be textured to match the feel of the cover, while for other sport balls, such as a soccer ball or football, the top of the button or cap may be smooth.

In a preferred embodiment, fibers or other reinforcing materials may be incorporated into the rubber compound or thermoplastic material of the button 58 during mixing. Examples of fibers or materials suitable for use include, but are not limited to, polyester, polyamide, polypropylene, Kevlar, cellulistic, glass and combinations thereof. Incorporation of fibers or other reinforcing materials into the button or cap 58 improves the durability of the button and improves the union of the button or cap and the piston 30, thus preventing the button or cap from shearing off during use. Although the pump would still function without the button, it would become very difficult to use.

Preferably, the button or cap 58 is co-injected with the piston 30 as one part. Alternatively, the button or cap 58 may be co-injected with a connecting piece, and the button or cap 58 and connecting piece may then be attached to the upper end of the piston 30 using an adhesive suitable for bonding the two pieces together. Co-injecting the button 58 and the piston 30 as one part, or alternatively, the button 58 and the connecting piece as one part that is mounted to the piston, provides a more durable part that is less likely to break or come apart during routine use of the ball. The button or cap material and the piston material need to be selected such that the two materials will adhere when co-injected. Testing of various combinations has shown that co-injecting or extruding a soft rubber button, such as a button comprising SANTOPRENE™, and a harder piston, such as polycarbonate or polypropylene and the like, provides a durable bond without the need for adhesives.

The piston and the connecting piece may be formed of any suitable material, such as, but not limited to polycarbonate (PC), polystyrene (PS), acrylic (PMMA), acrylonitrile-styrene acrylate (ASA), polyethylene terephthalate (PET), acrylonitrile-butadiene styrene (ABS) copolymer, ABS/PS blends, polypropylene (preferably high impact polypropylene), polyphenylene oxide, nylon, combinations thereof, or any suitable material known in the art. Materials with high impact strength are preferred. The material used for the piston is preferably clear or transparent to allow the pressure-indicating device 72 to be viewed by the user.

As further illustrated in FIGS. 4-11, preferably mounted on the upper surface of the cylinder cap 50 is a pad 60 that is engaged by the button 58 when the piston 30 is pushed down against the previously described spring 34 to lock or unlock the piston 30. The pad 60 provides cushioning to the pump. The underside of the cap 58 may be flexible or soft to provide further cushioning to the pump.

Figure 14:
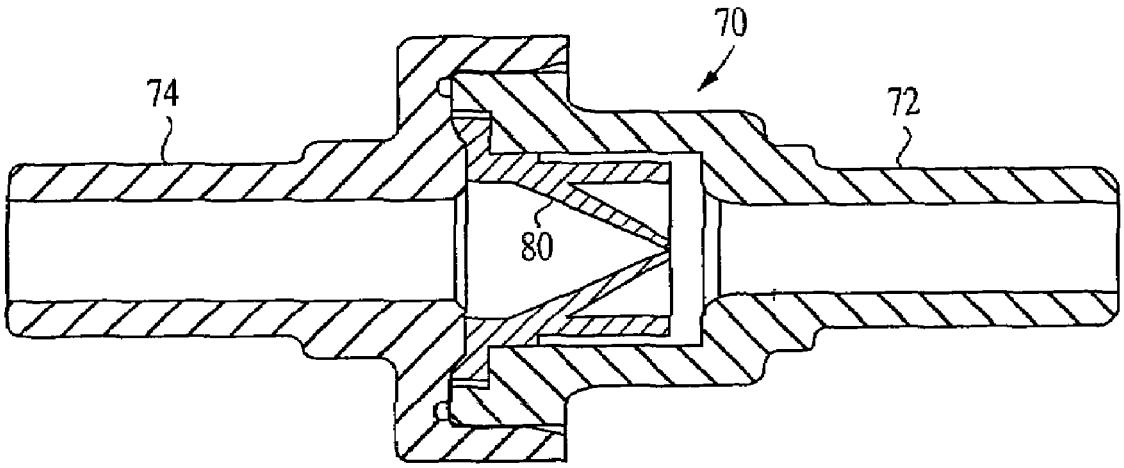
FIG. 14 is a cross section of a preferred nozzle component for use in the pump of the present development.
Figure 15:
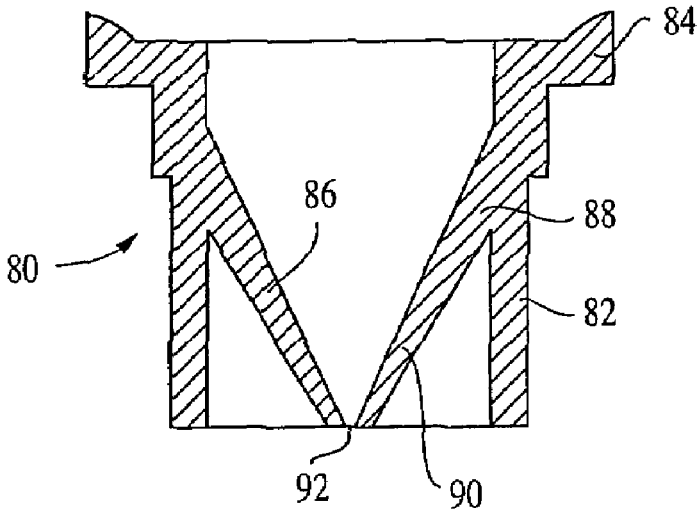
FIG. 15 is a cross section of a preferred duckbill valve used in the nozzle component illustrated in FIG. 14.

FIGS. 4-11 of the drawings depict a pump exit nozzle 46. Shown in FIG. 14 is a preferred embodiment of a one-way valve assembly 70 of the duckbill-type to be mounted in the nozzle 46. This assembly 70 comprises an inlet end piece 74, an outlet end piece 72 and an elastomeric duckbill valve 80 captured between the two end pieces 72, 74. The end pieces 72 and 74 are preferably plastic, such as a polycarbonate, polypropylene, nylon, polyethylene, or combinations thereof, but may be any material suitable for use. The end pieces may be ultrasonically welded together. Although any desired one-way valve can be used on the exit nozzle 70 and although duckbill valves are a common type of one-way valves, a specific duckbill configuration is shown in FIG. 15. The duckbill valve 80 is preferably formed of an elastomeric silicone material and is molded with a cylindrical barrel 82 having a flange 84. Inside of the barrel 82 is the duckbill 86 which has an upper inlet end 88 molded around the inside circumference into the barrel 82. The walls or sides 90 of the duckbill 86 then taper down to form the straight-line lower end with the duckbill slit 92. The duckbill functions wherein inlet air pressure forces the duckbill slit 92 open to admit air while the air pressure inside of the ball squeezes the duckbill slit closed to prevent the leakage of air. Such a duckbill structure is commercially available from Vernay Laboratories, Inc. of Yellow Springs, Ohio. Any type of one-way valve or other valve capable of sealing known in the art may be used, as long as it prevents air from flowing out of the interior of the ball when not desired.

Figure 16:
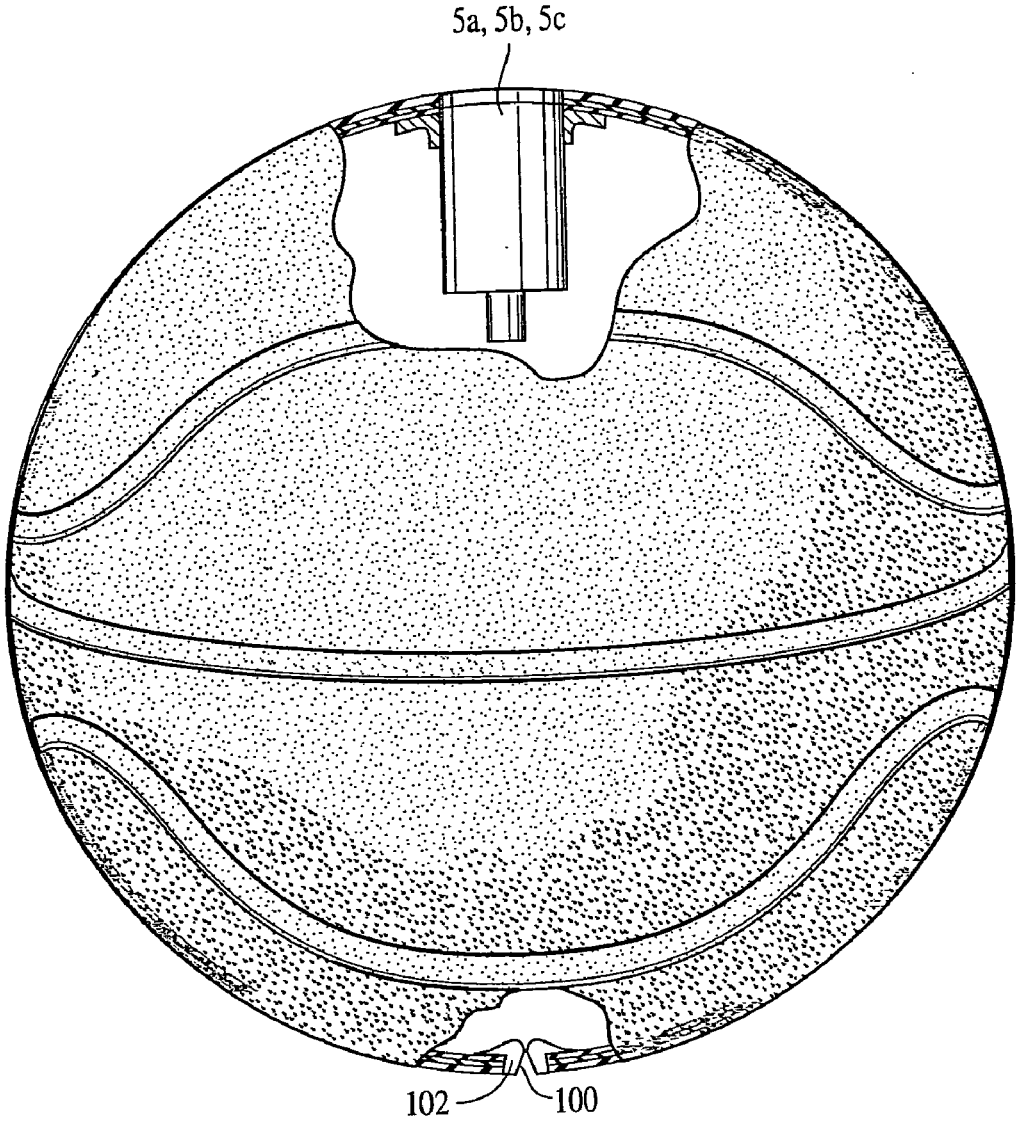
FIG. 16 is another preferred embodiment of a game ball according to the present disclosure.

A pump assembly of the type described and illustrated in the referenced figures is preferably made primarily from plastics such as polystyrene, polyethylene, nylon, polycarbonate and combinations thereof, but it can be made of any appropriate material known in the art. Although the assembly is small and light weight, perhaps only about 5 to about 25 grams, a weight may optionally be added to the ball structure to counterbalance the weight of the pump mechanism. In such an application, the weight, i.e. the counterweight, is positioned on or within the ball, and has a suitable mass, such that the resulting center of mass of the ball coincides with the geometric center of the ball. In lighter weight or smaller balls, such as a soccer ball, the pump assembly may weigh less and/or be smaller (shorter) than a corresponding pump assembly for a heavier ball, such as a basketball. FIG. 16 illustrates such a counterbalance arrangement wherein a pump mechanism generally designated 5*a*, 5*b*, 5*c* is on one side of the ball and a standard needle valve 100 is on the opposite side of the ball. In this case, the material 102 forming the needle valve 100 is weighted. Additional material can be added to the needle valve housing or the region surrounding the valve. Alternatively, a dense metal powder such as tungsten could be added to the rubber compound. The use of another pump or inflation valve is referred to herein as a secondary pump or inflation valve.

The description and the drawings referenced herein describe a particular and one preferred pump arrangement. However, other pump arrangements can be used within the scope of the disclosure. Examples of other pump arrangements that may be used with the development are shown in co-pending Application Ser. No. 09/594,980, filed Jun. 15, 2000; Ser. No. 09/594,547, filed Jun. 14, 2000; Ser. No. 09/594,180, filed Jun. 14, 2000; and Ser. No. 09/560,768, filed Apr. 28, 2000, incorporated herein by reference. Additional details and features that may be implemented in conjunction with the balls and pumps described herein are provided in U.S. Application publication No. US 2002/187866, filed as Ser. No. 10/183,337 on Jun. 25, 2002; U.S. Pat. No. 6,491,595, filed as Ser. No. 09/712,116 on Nov. 14, 2000; and U.S. Pat. No. 6,287,225 filed as Ser. No. 09/478,225 on Jan. 6, 2000, all of which are hereby incorporated by reference.

Since the pressure in a sport ball can be too high through overinflation or a temperature increase, or too low through underinflation or air loss, it can be beneficial to have a pressure relief device and/or a pressure-indicating device that is integral to the pump. If the pressure is too low, additional air may be added using the self-contained pump of the disclosure. If the pressure is too high, the pressure may be relieved by bleeding pressure from the ball with the conventional inflating needle or other implement that will open the conventional inflation valve to release air. Alternatively, the pump may have a mechanism that allows the pressure to be relieved, either through action of the pump, or through the use of a relief mechanism built into the pump, such as a mechanism to open the one-way valve if desired to allow air to flow out of the interior of the ball. The pressure-indicating device of the present development may then be used to determine if the ball is correctly inflated. If too much air is removed, additional air may be added using the pump.

In a particularly preferred embodiment, a pressure sensor and indicator are incorporated in a sport ball having a self-contained inflation mechanism as described herein.

Figure 17:
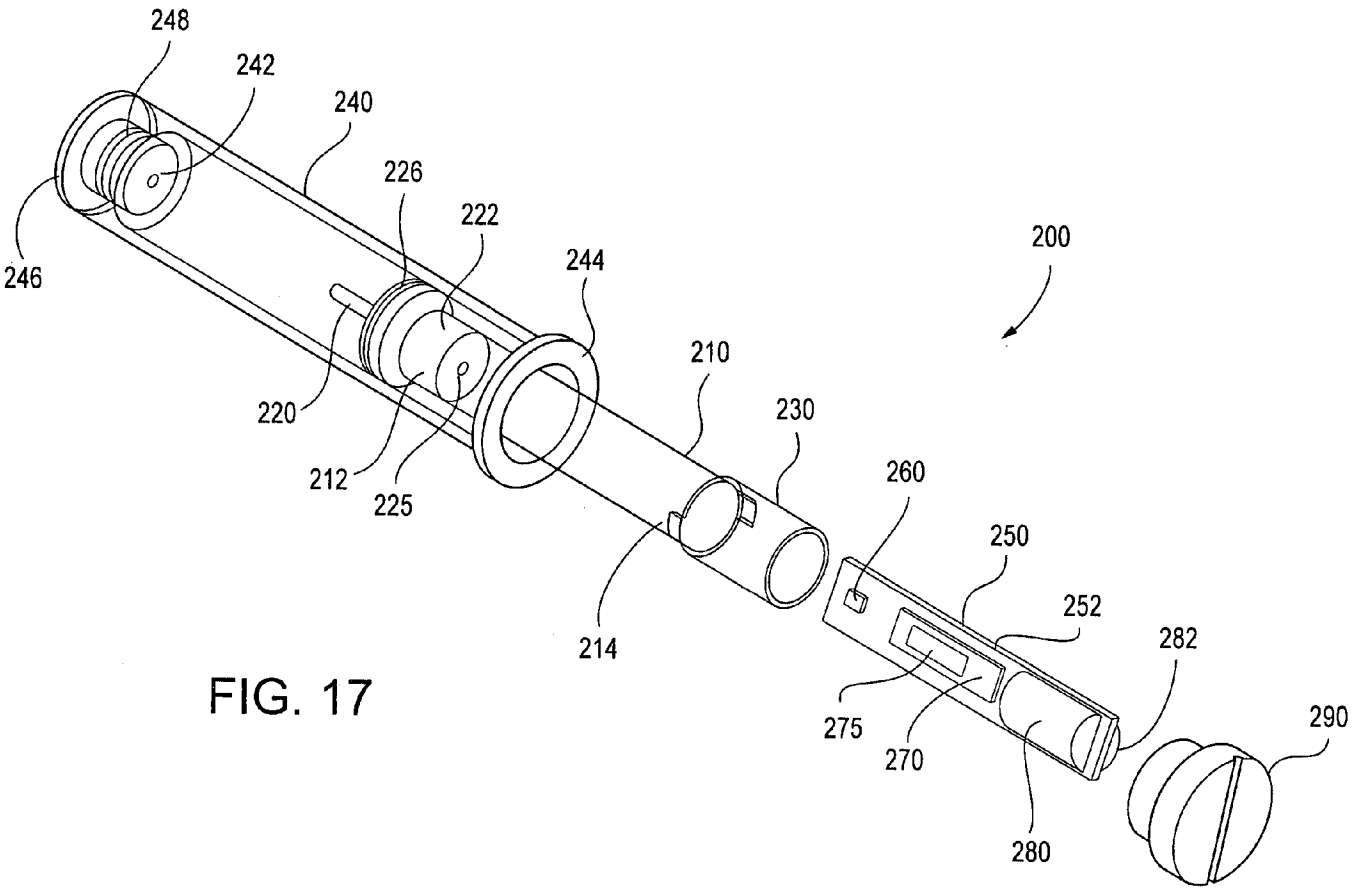
FIG. 17 is an exploded perspective view of a preferred embodiment pump assembly having a pressure sensor and pressure indicator according to the present development.

FIG. 17 illustrates a preferred embodiment pump, pressure indicator, and pressure sensor assembly 200 in accordance with the present disclosure. The assembly 200 comprises a cylinder 240 and a plunger (or piston) 210. Affixed or otherwise secured within the plunger 210 is a pressure sensor and indicator component 250.

Specifically, the plunger 210 defines a first end 212 at which is disposed a needle member 220 defining an air flow passage. The needle extends from a base 222 of the plunger 210. The base 222 supports the needle 220 and defines an aperture 225 which provides flow communication to the interior of the plunger 210. The plunger 210 also defines a second end 214, generally opposite from the first end 212. The second end 214 is adapted to receive the pressure sensor and indicator component 250. The plunger 210 is generally hollow and defines an interior volume accessible from the second end 214. An optional adapter component 230 can be utilized to engage or promote receipt of the pressure indicator and sensor component 250.

The cylinder 240 also defines a generally hollow interior region extending between a first end 246 and a second end 244 opposite from the first end 246. Disposed at the first end 246 of the cylinder 240 is a valve component 248 defining an actuation port 242, described in greater detail herein.

The pressure indicator and pressure sensor component 250 includes a member or substrate 252 on which are disposed a pressure sensor 260, a pressure indicator 270 providing a display 275 or other visual indicia representative of the sensed pressure, and one or more batteries 280, 282. The pressure sensor 260 senses, measures, or otherwise determines the pressure of its surroundings, i.e. the internal region of the plunger 210 and transmits that information to the pressure indicator 270. The indicator 270 provides a visual display of the sensed pressure, such as at display 275. The pressure sensor 260 and/or the pressure indicator 270 may be powered by one or more sources of electrical power such as for example low voltage batteries 280, 282.

The assembly 200 can further comprise an optional end cap 290 that engages the end 214 or component 230 of the plunger 210. The end cap 290 also serves to seal the interior hollow region of the plunger 210 from the external environment and thus ensure that the pressure sensor 260 only measures the pressure within that region. This is described in greater detail herein.

In this particular embodiment assembly 200, since the pressure indicator and sensor component 250 is affixed and sealed within the plunger 210, it is preferred that the plunger 210 be formed of a transparent material or at least define a viewing window through which the pressure indicator 270 and specifically the display 275, is observable.

Figure 18:
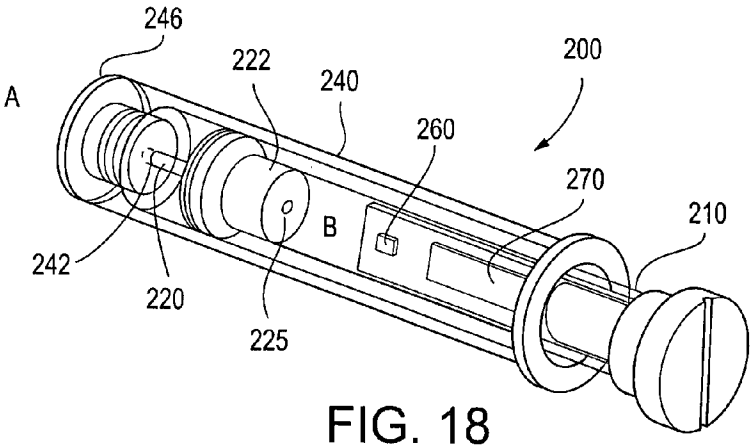
FIG. 18 is another perspective view of the assembly depicted in FIG. 17.
Figure 19:
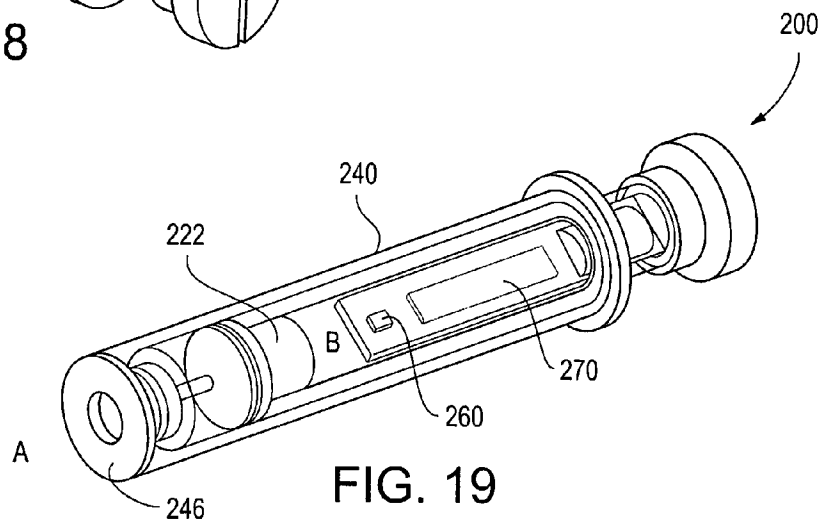
FIG. 19 is yet another perspective view of the assembly depicted in FIGS. 17 and 18.

Operation of the preferred assembly 200 is as follows. Referring to FIG. 17 and also FIGS. 18 and 19, the plunger 210 is inserted or otherwise depressed into the cylinder 240 so that the distal end of the needle 220 is inserted within, or otherwise engaged with, the actuation port 242 of the valve component 248. This actuation opens the valve and allows air (or other gas) external to the cylinder 240, such as within the interior of the ball, to flow through the valve component 248, through the needle 220, out of the aperture 225, and into the interior region of the plunger 210. Referring to FIGS. 18 and 19, in this operation, air flows from region A to region B.

Pressure equalization between regions A and B occurs rapidly as region B is soon at the same pressure as the interior of the ball, i.e. region A. The pressure sensor 260 senses, measures, or otherwise determines this pressure and transmits an electrical signal to the pressure indicator 270 for display.

It will be appreciated that it is generally preferred that the pressure sensor and/or pressure indicator provide a memory function such that a sensed pressure to be displayed is displayed for an extended period of time, such as for example from about 1 to about 10 seconds. After engaging the plunger within the cylinder to allow pressurized air to enter the region within the plunger and enable the pressure sensor to sense the pressure of that air, in order to view the displayed or indicated pressure, the plunger is withdrawn or extended away from the cylinder. That operation disengages the needle from the valve disposed at the base of the cylinder and thereby closes air flow between regions A and B. Depending upon the valving arrangement or configuration (if any) at the needle, the contents of the hollow plunger can escape thereby resulting in a loss of pressure. Without a memory or "temporary hold" of the measured pressure, upon withdrawing the plunger to view the pressure reading, that value would rapidly plummet.

The present disclosure, however, also includes the use of various valving and sealing arrangements to accomplish this pressure hold. These configurations could be used instead of, or in addition to, an electronic memory or pressure hold for the pressure indicator. For example, it is contemplated to use a selectively releasable one-way valve in the needle which allows air flow into the interior of the plunger but not out of the plunger. After reading a measured pressure, a user could selectively release the one-way valve to allow air to travel out of the plunger interior. Alternately, the needle could be configured to allow flow in both directions, and a sealing assembly could be used between the plunger and interior of the cylinder. A representative sealing assembly 226 is shown in FIG. 17.

The actuation of a pressure measurement is preferably only performed upon a full engagement or depression of the plunger within the cylinder. That is, in typical pumping operations, the needle 220 is not engaged with the port 242 of the valve member 248.

A wide array of pressure sensors may be used in the preferred embodiment sport balls. It is generally preferred that the sensor be configured to measure gauge pressure, and so, measure the pressure of the ball with respect to atmospheric pressure. However, it is also contemplated to utilize a sensor adapted to provide an absolute pressure measurement.

The term "pressure sensor" is used herein. However, it will be understood that, that term includes both pressure sensors and pressure transducers. A wide array of sensors and transducers may be used, such as, but not limited to piston technology, mechanical deflection, strain gauge, semiconductor piezoresistive, piezoelectric (including dynamic & quasistatic measurement), microelectromechanical systems (MEMS), vibrating elements (silicon resonance, for example), and variable capacitance.

Similarly, a wide variety of strategies, for receiving and displaying data relating to the measured pressure can be used in the preferred embodiment balls. An electrical signal from the pressure sensor or transducer representing the measured pressure is preferred and can be in either analog or digital form.

Similarly, the pressure indicator or display can be in nearly any form. Although a numeric digital readout or display is preferred, the present development includes the use of graphical or pictorial displays to indicate pressure within the interior of the ball. Besides or in addition to a numerical display, it is also contemplated to use an alpha-character display or one in which words or phrases are displayed in response to particular pressure levels detected by the pressure sensor. For example, if the pressure is within a predetermined acceptable range, a designation of "GOOD" or "OK" can be shown. Other words, terms, or phrases are contemplated such as, but not limited to "CORRECT", "PROPER", "FINE", "ALL-RIGHT", "SUPER", "COOL" and the like. Alternatively, if the measured pressure is too high or too low, designations of "HIGH" or "LOW" could be shown. Other words, terms, or phrases are contemplated such as for example "EXCESS", "EXCESSIVE", "TOO MUCH", "OVERKILL"; or "TOO LITTLE", "NOT ENOUGH", "MORE", "DEFICIENT", "NEEDING", and the like.

The present development can be utilized, wholly or partially, in conjunction with any type of inflatable sport ball or object, such as, but not limited to, basketballs; volleyballs; footballs; soccer balls; rugby balls; exercise balls; water polo balls; net balls; and miscellaneous sport balls; beachballs; other beach inflatable items; toy inflatable baseballs, golfballs, and other replica products; tennis balls; racquet balls; sport seat cushions; inflatable furniture such as chairs, mattresses; miniature inflatables; giant inflatables; inflatable pool products, toys, floatation mats, rafts, mattresses; inflatable wading pools; balloon-based products; inflatable structures and tents; inflatable snow products; and the like.

The foregoing description is, at present, considered to be the preferred embodiments of the present disclosure. However, it is contemplated that various changes and modifications apparent to those skilled in the art may be made without departing from the present development. Therefore, the foregoing description is intended to cover all such changes and modifications encompassed within the spirit and scope of the present disclosure, including all equivalent aspects.

We claim:

1. An inflatable sport ball having an integral pump, pressure sensor and indicator assembly, and pressure relief mechanism, said ball comprising:

a flexible carcass including an inflatable bladder having an interior adapted for retaining pressurized air, and an outer layer disposed on said bladder;

a pump cylinder secured to said carcass, said cylinder including a distal end at which is disposed a valve, said cylinder defining an interior hollow chamber in communication with said interior of said bladder through said valve;

a pump piston disposed in said cylinder, said piston positionable within said cylinder, said piston including a distal end at which is disposed an actuating member;

a pressure sensor and pressure indicator assembly incorporated in the ball and adapted to indicate the internal pressure of the ball;

wherein said piston and said cylinder are configured such that upon selective positioning of said piston, said actuating member engages said valve to selectively provide passage and escape of pressurized air from within said bladder.

2. The sport ball of claim 1 where said pump cylinder further includes an open end opposite from said distal end of said cylinder, and a cylindrical sidewall extending between said open end and said distal end.

3. The sport ball of claim 1 wherein said pump piston defines an annular recess along said distal end of said piston, and said ball further comprises:

a coil spring disposed in said annular recess and engaging said cylinder and said piston such that said spring urges said piston away from said distal end of said cylinder.

4. The sport ball of claim 1 wherein said actuating member of said piston is a needle.

5. The sport ball of claim 1 wherein said sport ball is selected from the group consisting of a basketball, a football, a soccer ball, and a volleyball.

6. The sport ball of claim 5 wherein said ball is a basketball.

7. The sport ball of claim 5 wherein said ball is a football.

8. The sport ball of claim 1 further comprising: a secondary valve disposed in said carcass.

9. The sport ball of claim 1, wherein the pressure indicator provides a numerical indication of the internal pressure of the ball.

10. The sport ball of claim 1, wherein the pressure indicator is disposed on the piston and movable therewith.

11. The sport ball of claim 1, wherein the pressure indicator is only visible when the piston is in an extended position or a position between an extended position and an inserted position.

12. An inflatable sport ball having an integral pump and pressure indicating assembly, said ball comprising:

a flexible carcass including an inflatable bladder having an interior adapted for retaining pressurized air, and an outer layer disposed on said bladder;

a pump cylinder secured to said carcass, said cylinder including a nozzle end, said cylinder defining an interior hollow chamber in communication with said interior of said bladder through said nozzle end;

a pump piston disposed and positionable within said cylinder, said piston including a distal end, said piston including a pressure sensor and a pressure indicating assembly incorporated within the pump assembly, the pressure sensor adapted to sense and measure the pressure of the interior of the bladder, and provide a signal to the pressure indicator representative of such measured pressure, the pressure indicator adapted to indicate the measured pressure of the ball;

wherein upon engagement between said distal end of said piston and said nozzle end of said cylinder, said pressure sensor is placed in communication with the interior of said bladder and thereby causing said pressure indicator to indicate the pressure within the ball.

13. The sport ball of claim 12 wherein said sport ball is selected from the group consisting of a basketball, a football, a soccerball, and a volleyball.

14. The sport ball of claim 13 wherein said sport ball is a basketball.

15. The sport ball of claim 13 wherein said sport ball is a football.

16. The sport ball of claim 12 wherein said ball further comprises:

a pressure relief assembly adapted to selectively allow passage and escape of air from the interior of said ball.

17. The sport ball of claim 12 further comprising:

a secondary valve disposed in said carcass.

18. The ball of claim 12, wherein the pressure indicator is secured to the plunger and movable therewith.

19. The ball of claim 12, wherein the pressure indicator provides a numerical indicator of the internal pressure of the ball.

20. An inflatable sport ball having an integral pump, pressure relief mechanism, and pressure indicating assembly, said ball comprising:

a flexible carcass including an inflatable bladder having an interior adapted for retaining pressurized air, and an outer layer disposed on said bladder;

a pump cylinder secured to said carcass, said cylinder including a distal end at which is disposed a valve for providing communication with said interior of said bladder, said cylinder defining an interior hollow chamber in communication with said interior of said bladder through said valve;

a pump piston disposed in said cylinder, said piston positionable within said cylinder, said piston including distal end at which is disposed an actuating member;

a pressure sensor integral with the piston and adapted to measure air pressure within the ball body; and a pressure indicator integral with the piston and in communication with the pressure sensor, the indicator adapted to provide an indication of the pressure measured by the pressure sensor;

wherein said piston and said cylinder are configured such that upon selective positioning of said piston (i) said member engages said valve to selectively provide passage and escape of pressurized air from within said bladder, and (ii) said pressure sensor is placed in communication with the interior of said bladder and thereby causing said pressure indicator to indicate the pressure within said interior.

21. The sport ball of claim 20 where said pump cylinder further includes an open end opposite from said distal end of said cylinder, and a cylindrical sidewall extending between said open end and said distal end.

22. The sport ball of claim 20 wherein said pump piston defines an annular recess along said distal end of said piston, and said ball further comprises:

a coil spring disposed in said annular recess and engaging said cylinder and said piston such that said spring urges said piston away from said distal end of said cylinder.

23. The sport ball of claim 20 wherein said actuating member of said piston is a needle.

24. The sport ball of claim 20 wherein said sport ball is selected from the group consisting of a basketball, a football, a soccerball, and a volleyball.

25. The sport ball of claim 24 wherein said sport ball is a basketball.

26. The sport ball of claim 24 wherein said sport ball is a football.

27. The sport ball of claim 20 further comprising:

a secondary valve disposed in said carcass.

28. The inflatable ball of claim 20, wherein the pressure indicator provides a numerical indication of the air pressure within the ball body.

29. The inflatable ball of claim 20 wherein the pressure indicator provides an alpha-character indication of the air pressure within the ball body.

30. The inflatable ball of claim 20 wherein the pressure indicator provides a graphical indication of the air pressure within the ball body.

* * * * *